US009300085B2

(12) United States Patent
Morello et al.

(10) Patent No.: US 9,300,085 B2
(45) Date of Patent: Mar. 29, 2016

(54) ELECTRICAL WIRING ASSEMBLY AND VIBRATION RESISTANT ELECTRICAL CONNECTOR FOR SAME

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/463,688

(22) Filed: Aug. 20, 2014

(65) Prior Publication Data

US 2016/0056575 A1 Feb. 25, 2016

(51) Int. Cl.

| | |
|---|---|
| ***H01R 13/40*** | (2006.01) |
| ***H01R 13/639*** | (2006.01) |
| ***H01R 13/627*** | (2006.01) |
| ***H01R 24/28*** | (2011.01) |

(52) U.S. Cl.

CPC ..... *H01R 13/639* (2013.01); *H01R 13/6275* (2013.01); *H01R 24/28* (2013.01)

(58) Field of Classification Search

CPC ..... H01R 13/4223

USPC ..... 439/595

See application file for complete search history.

(56) References Cited

U.S. PATENT DOCUMENTS

| | | | | |
|---|---|---|---|---|
| 5,240,434 | A * | 8/1993 | Yagi | H01R 13/4223 439/594 |
| 6,244,900 | B1 * | 6/2001 | Ishikawa | H01R 13/4223 439/595 |
| 6,375,503 | B2 * | 4/2002 | Ohsumi | H01R 13/4364 439/595 |
| 6,692,303 | B2 * | 2/2004 | Fukatsu | H01R 43/16 439/595 |
| 6,695,620 | B1 | 2/2004 | Huang | |
| 7,048,584 | B1 * | 5/2006 | Morello | H01R 13/422 439/595 |
| 7,252,556 | B2 | 8/2007 | Anbo et al. | |
| 7,438,585 | B2 | 10/2008 | Morello | |
| 7,867,029 | B2 * | 1/2011 | Takahashi | H01R 13/4223 439/595 |
| 2002/0086559 | A1 | 7/2002 | Dalmau Ferrerfabrega | |
| 2009/0117783 | A1 | 5/2009 | Wu | |
| 2013/0065407 | A1 | 3/2013 | Schichl et al. | |
| 2014/0127926 | A1 | 5/2014 | Condo et al. | |

FOREIGN PATENT DOCUMENTS

| | | |
|---|---|---|
| JP | 2013525967 A | 6/2013 |

* cited by examiner

*Primary Examiner* — Neil Abrams
(74) *Attorney, Agent, or Firm* — Robert J. Myers

(57) ABSTRACT

An electrical connector including a connector body that defines a terminal cavity within the connector body and an electrical terminal at least partially disposed within the terminal cavity. A first cavity wall within the terminal cavity defines a longitudinally oriented wedge feature. A biasing feature within the terminal cavity is configured to urge the wedge feature into intimate contact with surfaces of the terminal, such as those defined by a longitudinally oriented slot, thereby limiting a freedom of motion of the terminal within the terminal cavity. The wedge feature may be defined by the biasing feature or it may be defined by another cavity wall opposite the biasing feature within the terminal cavity.

9 Claims, 8 Drawing Sheets

ELECTRICAL WIRING ASSEMBLY AND VIBRATION RESISTANT ELECTRICAL CONNECTOR FOR SAME

TECHNICAL FIELD OF THE INVENTION

The invention generally relates to an electrical connector, particularly an electrical connector designed to be exposed to mechanical vibration, such as occurs in an automotive environment.

BACKGROUND OF THE INVENTION

Wiring harness assemblies are often interconnected by electrical connectors having mating electrical terminals attached to each wire and the terminals are contained within cavities of mating connector bodies. Fretting corrosion of the terminals can result when the connectors are exposed to mechanical vibration due to the relative motion of the mated terminals with one another. Mechanical vibrations that can cause fretting corrosion may be experienced by electrical connectors used in automotive applications as well has aerospace or industrial machine applications.

Some electrical connectors have relied on a high contact force between the mated terminals to stabilize the terminals relative to each other in a vibratory environment. However, high contact forces between the terminals results in an undesirably high insertion force when mating the connectors. This high insertion force may exceed ergonomic guidelines for assembly operators connecting the electrical connectors and/or may require mating assist devices to be added to the electrical connector to decrease the force required to mate the electrical connector, adding undesirable cost to the electrical connector. Therefore, an electrical connector designed to minimize relative motion between mated terminals while avoiding increased contact force between the mated terminals is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical connector is provided. The electrical connector includes a connector body that defines a terminal cavity within the connector body and an electrical terminal at least partially disposed within the terminal cavity. A first cavity wall within the terminal cavity defines a longitudinally oriented wedge feature. A biasing feature within the terminal cavity is configured to urge the wedge feature into intimate contact with surfaces of the terminal, thereby limiting a freedom of motion of the terminal within the terminal cavity. The biasing feature may be characterized as a resilient cantilever beam. The terminal may be characterized as a socket terminal.

The biasing feature may be defined by a second cavity wall opposing the first cavity wall. A slot is defined in an external surface of the terminal. The biasing feature is configured to urge the wedge feature into intimate contact with surfaces of the slot, thereby limiting the freedom of motion of the terminal within the terminal cavity. The wedge feature is tapered away from the cavity walls adjacent the first cavity wall.

Alternatively, the wedge feature is defined by the biasing feature. A slot is defined in an external surface of the terminal and the biasing feature is configured to urge the wedge feature into intimate contact with surfaces of the slot.

The electrical connector may further include a retainer disposed between the biasing feature and the first cavity wall, wherein the retainer is configured to further urge the wedge feature into intimate contact with the surfaces of the slot.

In one embodiment of the electrical connector, the connector includes a connector body defining a terminal cavity and an electrical terminal at least partially disposed within the terminal cavity. The terminal defines a lateral locking edge and a longitudinal wedging surface. The electrical connector further includes a resilient locking arm depending from a wall of the terminal cavity having a lateral locking tab configured to engage the locking edge and a longitudinal wedge configured to engage the wedging surface. The locking arm vertically engages the terminal, thereby inhibiting lateral, longitudinal and vertical movement of the terminal within the terminal cavity. The locking arm may be characterized as a resilient cantilever beam. The electrical connector may further have a lock retainer disposed between the locking arm and the wall of the terminal cavity. The lock retainer is configured to urge the wedge into intimate contact with the wedging surface of the terminal. The wedging surface may be defined by a longitudinal slot in a connection section of the terminal and the slot is defined along an entire lateral length of the connection section of the terminal.

In another embodiment of the electrical connector, the connector includes a connector body defining a terminal cavity and an electrical terminal having a connection section disposed within the terminal cavity. The connection section of the terminal defines a lateral locking edge. The connector body includes a lateral locking tab depending from a first wall of the terminal cavity and configured to engage the locking edge, thereby inhibiting longitudinal movement of the terminal within the terminal cavity. The connector body also includes a resilient beam depending from a second wall of the terminal cavity opposing the first wall and configured to urge the connection section toward the first wall, thereby inhibiting vertical movement of the terminal within the terminal cavity. The connector body further includes a longitudinal wedge depending from the first wall of the terminal cavity. The connection section of the terminal defines a longitudinal slot configured to receive the wedge and the cantilever beam further urges an inner edge of the slot into intimate contact with the wedge, thereby inhibiting lateral movement of the terminal within the terminal cavity. The wedge may be forward and rearward of the locking tab. The slot may be forward and rearward of the locking edge. The terminal may be characterized as a socket terminal and the connection section defines a box shape.

In accordance with another embodiment, an electrical wiring assembly is provided. The electrical wiring assembly includes an electrically conductive wire and an electrical connector as described above, wherein the wire is electrically and mechanically connected to the electrical terminal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
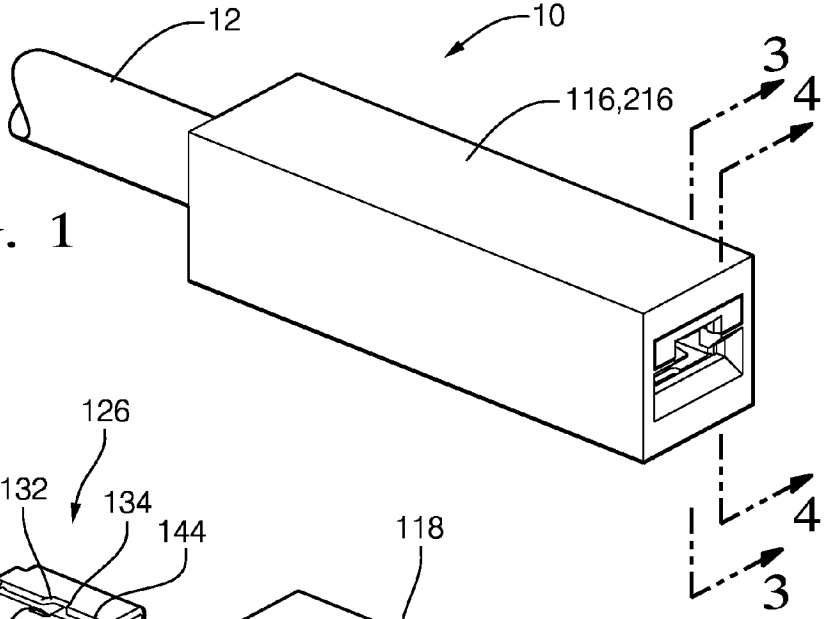
FIG. 1 is a perspective view of an electrical terminal according to a first and a second embodiment.

Presented herein is an electrical connector that is designed to reduce fretting corrosion between mated electrical terminals, such as a male plug terminal and a female socket terminal. The inventors have found that reducing the movement of at least one of the terminals within a terminal cavity of a connector body reduces the relative motion between the socket terminal and the plug terminal, thus reducing the occurrence and severity of fretting corrosion of the terminals. The embodiments described hereafter include a longitudinal wedging feature and a vertical biasing feature to limit vertical and lateral movement of the terminal within the terminal cavity.

Cross-referencing FIGS. 1-6, details of a first non-limiting example of an electrical wire assembly, generally referred to by the reference number 10, can be seen. The electrical wire assembly 10 contains an electrically conductive wire 12 that is attached to an electrical terminal 114 of an electrical connector, generally referred to by the reference number 116. The electrical connector 116 illustrated in FIG. 2 includes a connector body 118 that defines a terminal cavity 120 extending along a longitudinal axis X within the connector body 118. The terminal cavity 120 has two openings; the first opening 122 at an insertion end of the connector body 118 is configured to receive the terminal 114 when it is inserted within the terminal cavity 120. The second opening 124, opposite the first opening 122, is configured to position the terminal 114 within the connector body 118 so that it can receive a mating terminal of a mating electrical connector (not shown). The connector body 118 electrically insulates the terminal 114 and is typically formed of a dielectric material. The materials and processes used to form connector bodies are well known to those skilled in the art. Although the connector body 118 illustrated in FIG. 1 has a single terminal cavity 120, other embodiments of the electrical connector may be envisioned wherein the connector body includes a plurality of terminal cavities.

The electrical terminal 114 is at least partially disposed within the terminal cavity 120. The terminal 114 includes a connection section 126 configured to receive and connect with a mating terminal (not shown) and an attachment section 128 configured to receive and attach to the stands of the wire 12. The attachment section 128 illustrated here comprises a pair of crimping wings 130 that are configured to be mechanically crimped to the stands of the wire 12. Other means for attaching the wire 12 to the terminal 114, such as soldering or sonic welding, may be used and the design of the attachment section 128 may be revised accordingly. When inserted in the terminal cavity 120, the connection section 126 is proximate the second opening 124 of the terminal cavity 120 and the attachment section 128 is proximate the first opening 122 of the terminal cavity 120. The terminal 114 may be formed of a sheet of a conductive material, such as copper, by a process of stamping and bending. The materials and processes used to form electrical terminals are well known to those skilled in the art. While the embodiment illustrated in FIG. 2 contains a socket electrical terminal configured to receive a male blade terminal, other embodiments of the electrical connector may be envisioned using other terminal types, e.g. socket and pin.

The connection section 126 of the terminal 114 defines a rectangular opening 132 having a locking edge 134 defined by a forward edge that extends along a lateral axis Y and is configured to engage a lateral locking tab 136. As used herein, forward refers to a direction toward the first opening 122 of the connector body 118 and rearward refers to a direction toward the second opening 124 of the connector body 118. While the opening 132 in this example is rectangular, other embodiments of the electrical connector 116 may have a locking edge defined by an opening having another shape.

The connection section 126 also defines a wedging surface 138 along the longitudinal axis X that is configured to engage a longitudinal wedge 140. The wedging surface 138 is defined by a longitudinal slot 142 in the connection section 126. Particularly in this example; the wedging surfaces 138 are the edges 144 of the slot 142.

The electrical connector 116 also includes a biasing feature 146 within the terminal cavity 120 that biases, i.e. pushes the terminal 114 toward one side of the terminal cavity 120 and away from the opposite side of the terminal cavity 120. According to the embodiment of FIG. 2, the biasing feature 146 is a resilient locking arm 146 that depends from a wall 148 of the terminal cavity 120. The locking arm 146 is a cantilever beam with one end attached to the wall 148 of the terminal cavity 120 and extending along the longitudinal axis X to a free or unattached end 150. The locking arm 146 may be integrally formed with the connector body 118 and may be formed of the same material as the connector body 118. The locking arm 146 defines the locking tab 136 proximate the free end 150 of the locking arm 146. The locking tab 136 has a ramp 152 that slopes toward the first opening 122 of the terminal cavity 120. The ramp 152 leads to a lock shoulder 154 that extends along the lateral axis Y. Although the biasing feature 146 shown in this example is a resilient cantilever beam, other embodiments may be envisioned with alternative biasing features, such as compliant fixed beams, springs, or elastomeric elements.

Figure 3:
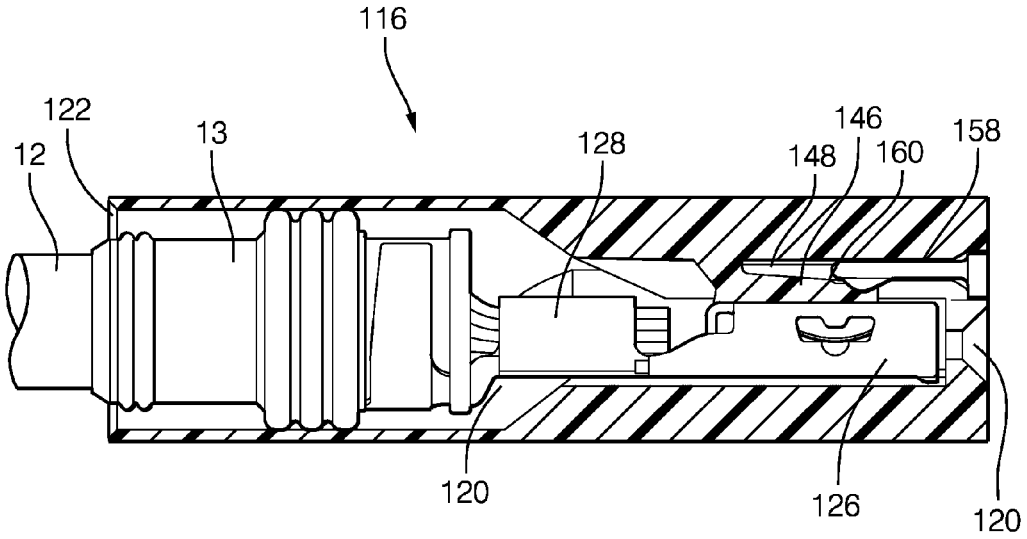
FIG. 3 is a cross section side view of the electrical terminal of FIG. 2 according to the first embodiment.
Figure 4:
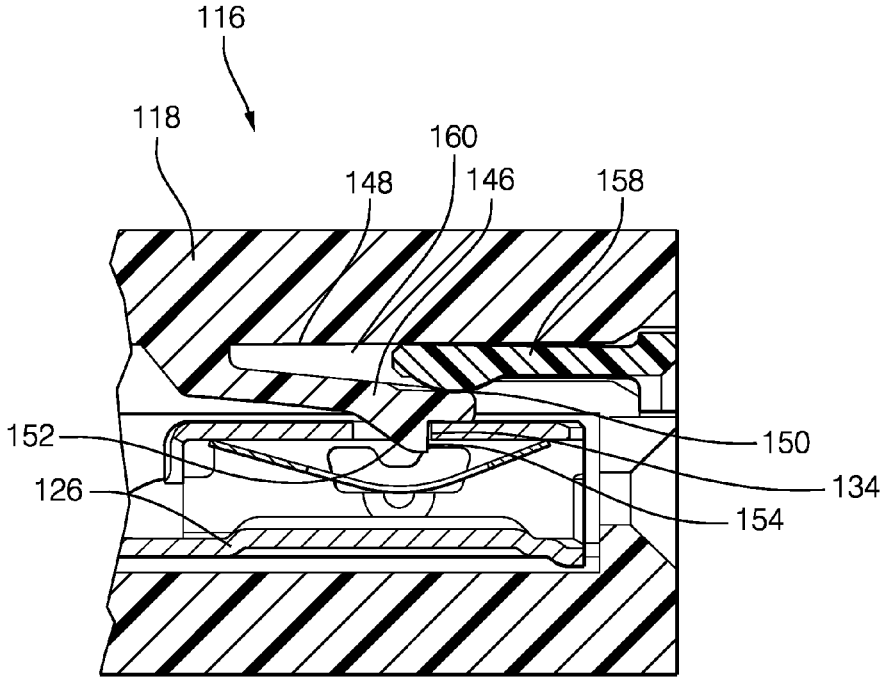
FIG. 4 is a partial cross section side view of the electrical terminal of FIG. 2 according to the first embodiment.
Figure 5:
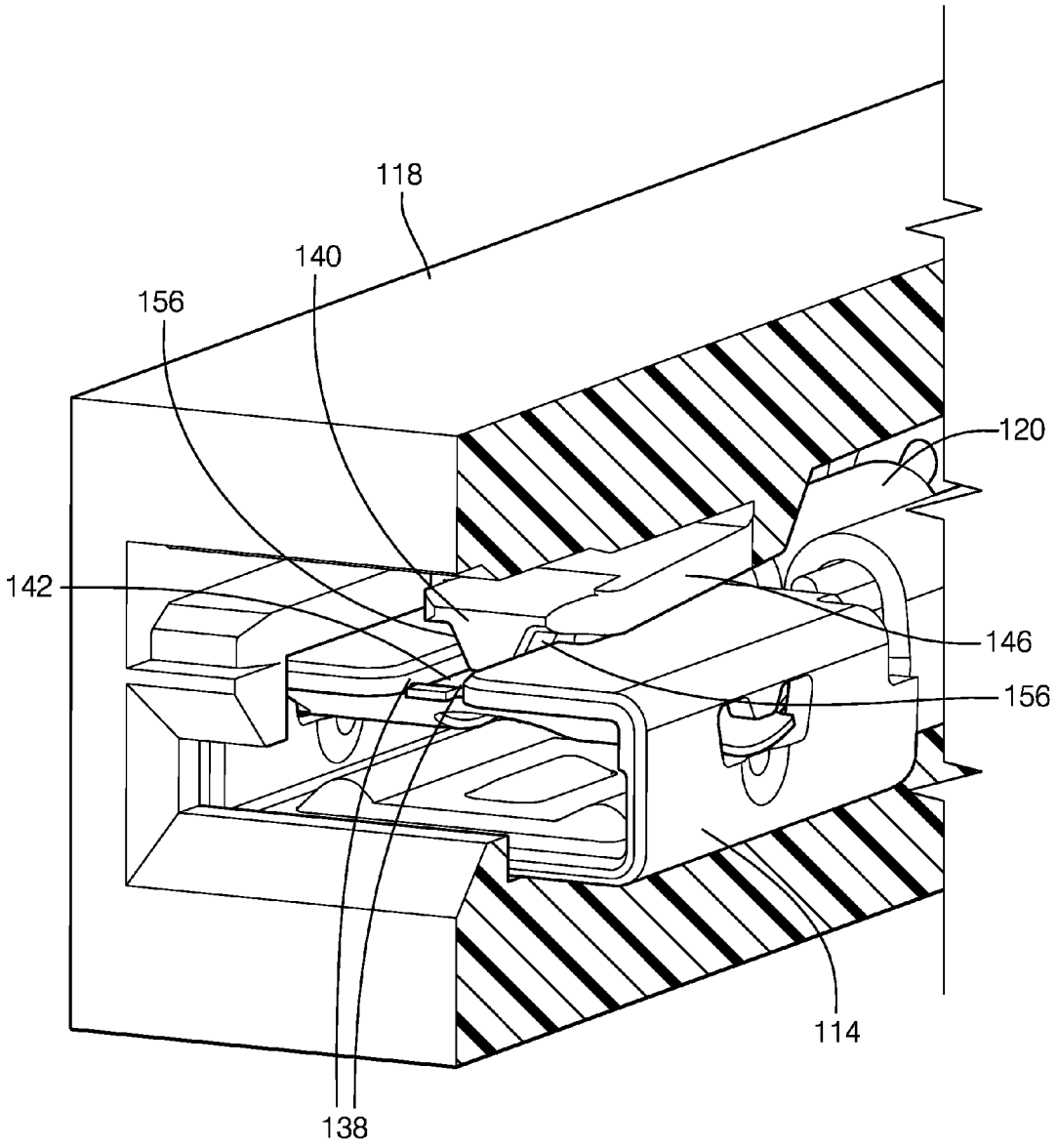
FIG. 5 is a partial cross section end view of the electrical terminal of FIG. 2 according to the first embodiment.
Figure 6:
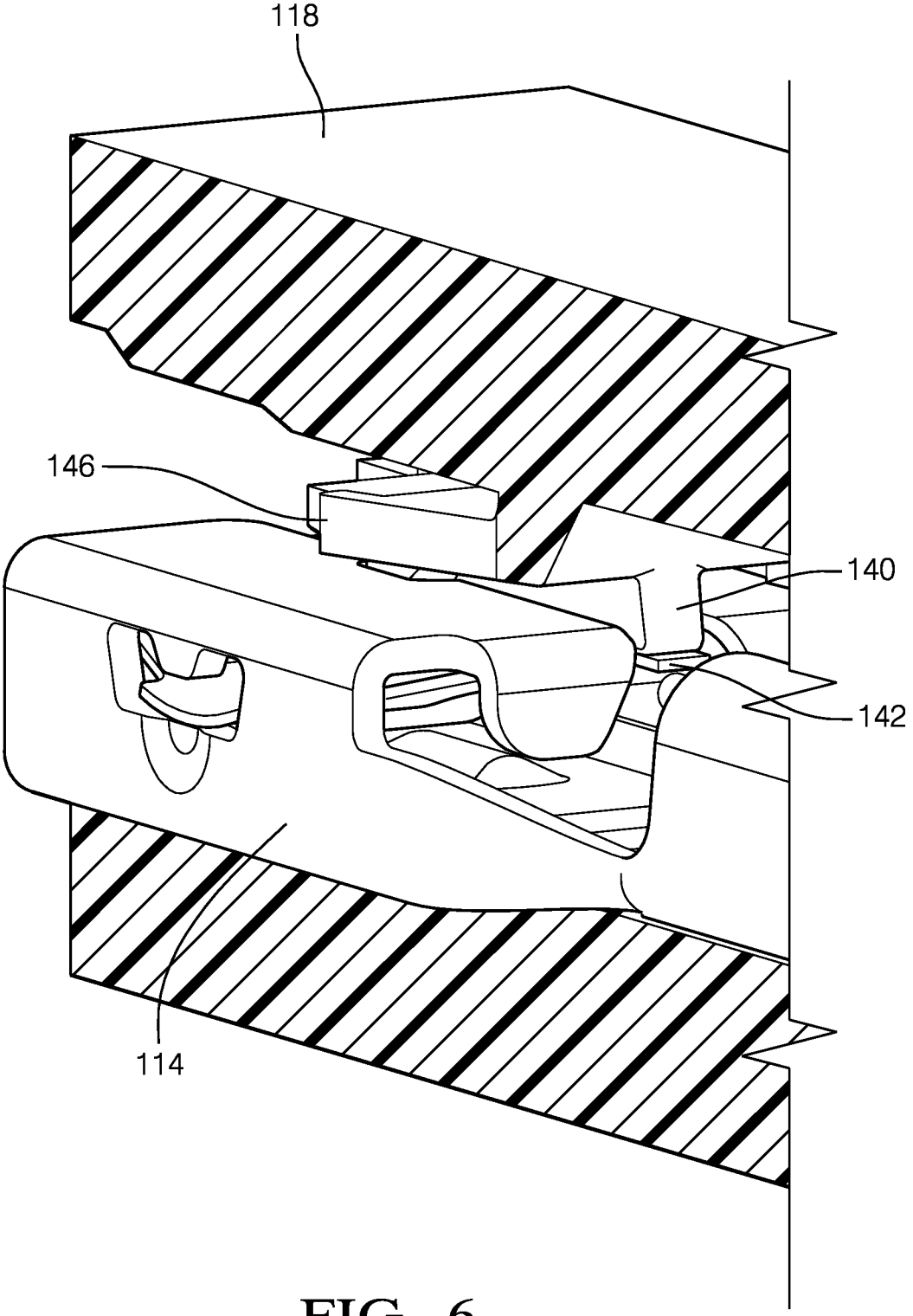
FIG. 6 is an alternate partial cross section end view of the electrical terminal of FIG. 2 according to the first embodiment.

The terminal 114 is inserted into the terminal cavity 120 through the first opening 122 at the insertion end of the connector body 118. As best shown in FIG. 3, when the connection section 126 of the terminal 114 engages the ramp 152 of the locking arm 146, the terminal 114 deflects the locking arm 146 along a vertical axis Z so that the ramp 152 of the locking arm 146 rides over the connection section 126 as the terminal 114 is further inserted within the terminal cavity 120. When the lock shoulder 154 reaches the locking edge 134 of the opening 132, the locking arm 146 springs back to a generally undeflected position and the lock shoulder 154 of the locking arm 146 engages the locking edge 134 of the terminal 114, inhibiting the terminal 114 from being pulled back out of the insertion end of the connector body 118 and inhibiting longitudinal movement of the terminal 114 within the terminal cavity 120.

The locking arm 146 also defines a wedge 140 extending longitudinally along the locking arm 146 proximate the free end 150. The sides 156 of the wedge 140 taper away from the locking arm 146 toward the terminal 114 and are configured to engage the wedging surfaces 138 of the slot 142. When the locking arm 146 springs back to the undeflected position the sides 156 of the wedge 140 are in intimate contact with the wedging surfaces 138 of the slot 142. Without subscribing to any particular theory of operation, the engagement of the wedge 140 with the wedging surfaces 138 inhibits lateral movement of the terminal 114 within the terminal cavity 120. In combination with the locking tab 136 which limits longitudinal motion of the terminal 114 and the locking arm 146 which limits vertical motion of the terminal 114, the movement of the terminal 114 within the terminal cavity 120 is inhibited in three orthogonal axes.

The electrical connector 116 further includes a lock retainer 158 that is disposed within a gap 160 between the free end 150 of the locking arm 146 and the wall 148 of the terminal cavity 120 from which the locking arm 146 depends. The lock retainer 158 is inserted into the gap 160 after the terminal 114 is fully inserted within that terminal cavity 120. In addition to inhibiting vertical movement of the locking arm 146 that could cause inadvertent release of the terminal 114 from the terminal cavity 120, the lock retainer 158 is configured to further urge the wedge 140 into intimate contact with the wedging surface 138 of the terminal 114.

Figure 2:
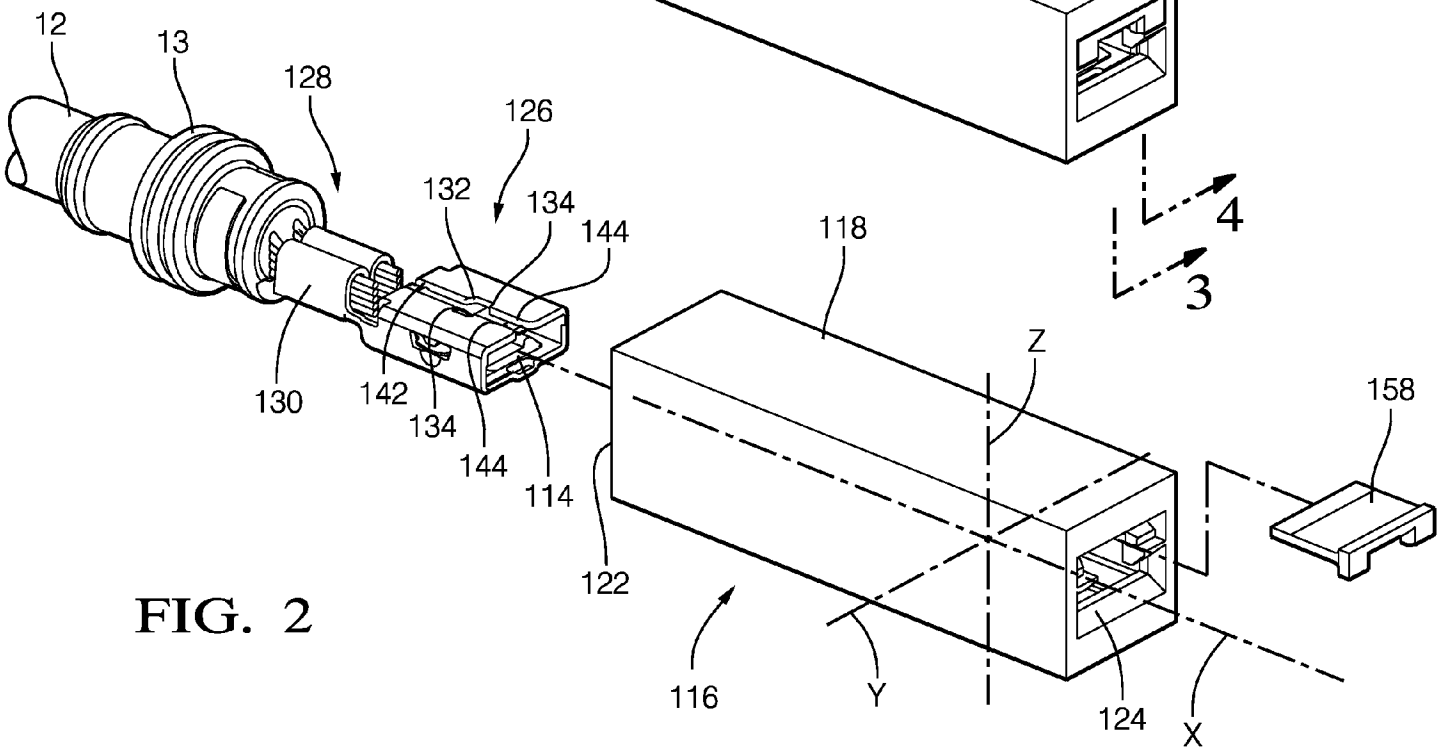
FIG. 2 is an exploded perspective view of an electrical terminal according to the first embodiment.

As best illustrated in FIG. 2, the slot 142 runs length of connection section 126. In addition to providing the wedging surface 138 for the wedge 140 of the locking arm 146, the slot 142 may cooperate with the wedge 140 to index terminals within the terminal cavity 120. The index may be used to center the terminal 114 within the terminal cavity 120 and/or ensure that the terminal 114 is properly oriented e.g. the terminal 114 is not inserted into the terminal cavity 120 upside down. In other embodiments of the connector, the slot 142 could be shorter, i.e. not run from the forward edge of the connection section 126 to the rearward edge of the connection section 126. Alternatively, the slot could be characterized by other shapes, such as an oval shape.

The wire assembly 10 also includes a compliant seal 13 that is configured to surround the wire 12 and be in intimate contact with the walls of the terminal cavity 120, thereby sealing the first opening 122 against intrusion by environmental contaminants such as fluids or dust.

Cross-referencing FIGS. 7-10, details of a second non-limiting example of an electrical connector, generally referred to by the reference number 216, can be seen. In contrast to the electrical connector 116 shown in FIG. 2-5, the biasing feature 246 is defined by a first wall 248 of the terminal cavity 220 and the wedge 240 and the locking tab 236 are defined by a second wall 262 opposite the biasing feature 246. The reference numbers of elements of the embodiment shown in FIGS. 6-9 that are similar to the elements of the embodiment shown in FIGS. 2-5 differ by 100.

Figure 7:
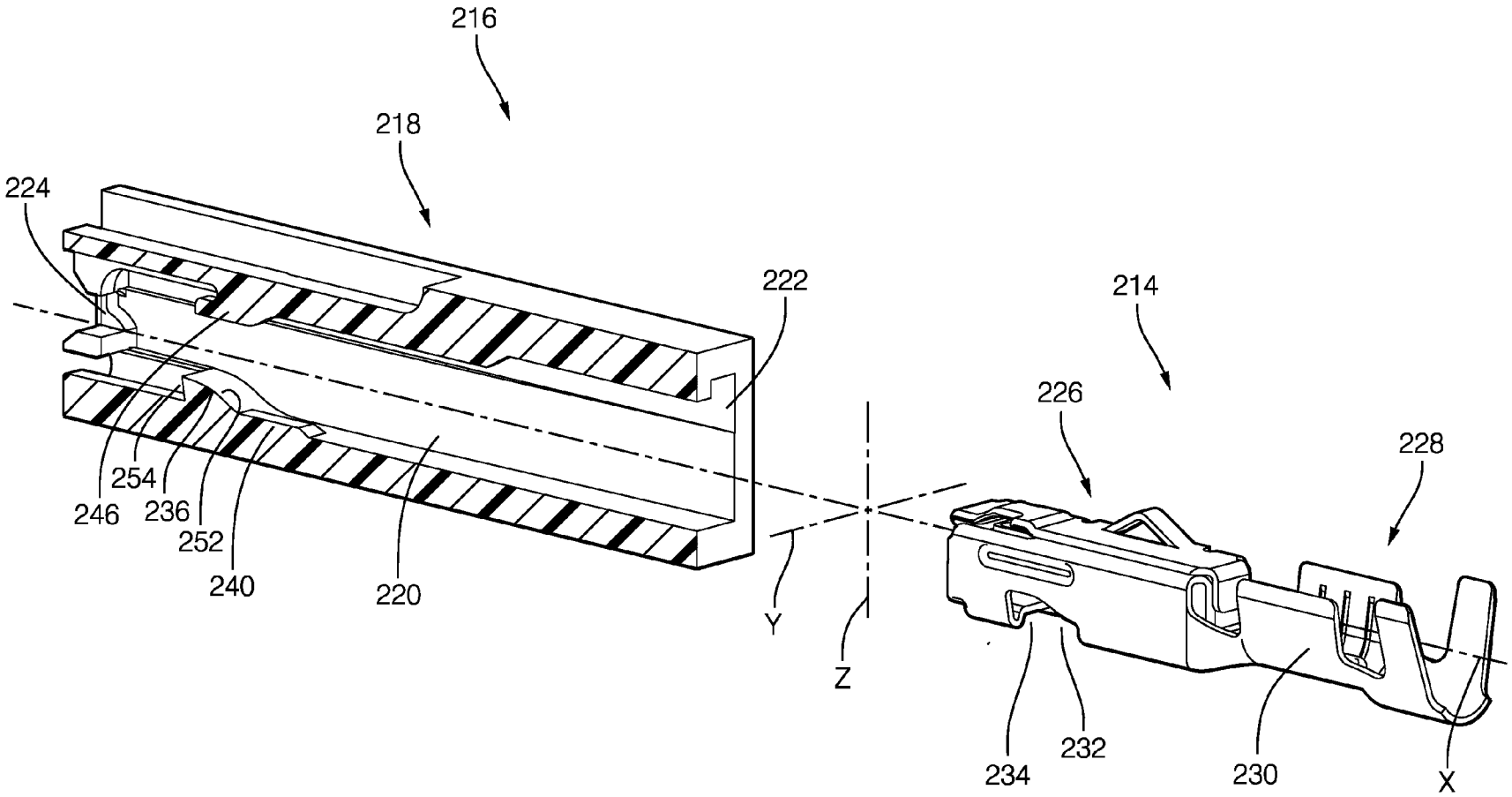
FIG. 7 is an exploded cross section perspective view of an electrical connector according to the second embodiment.
Figure 8:
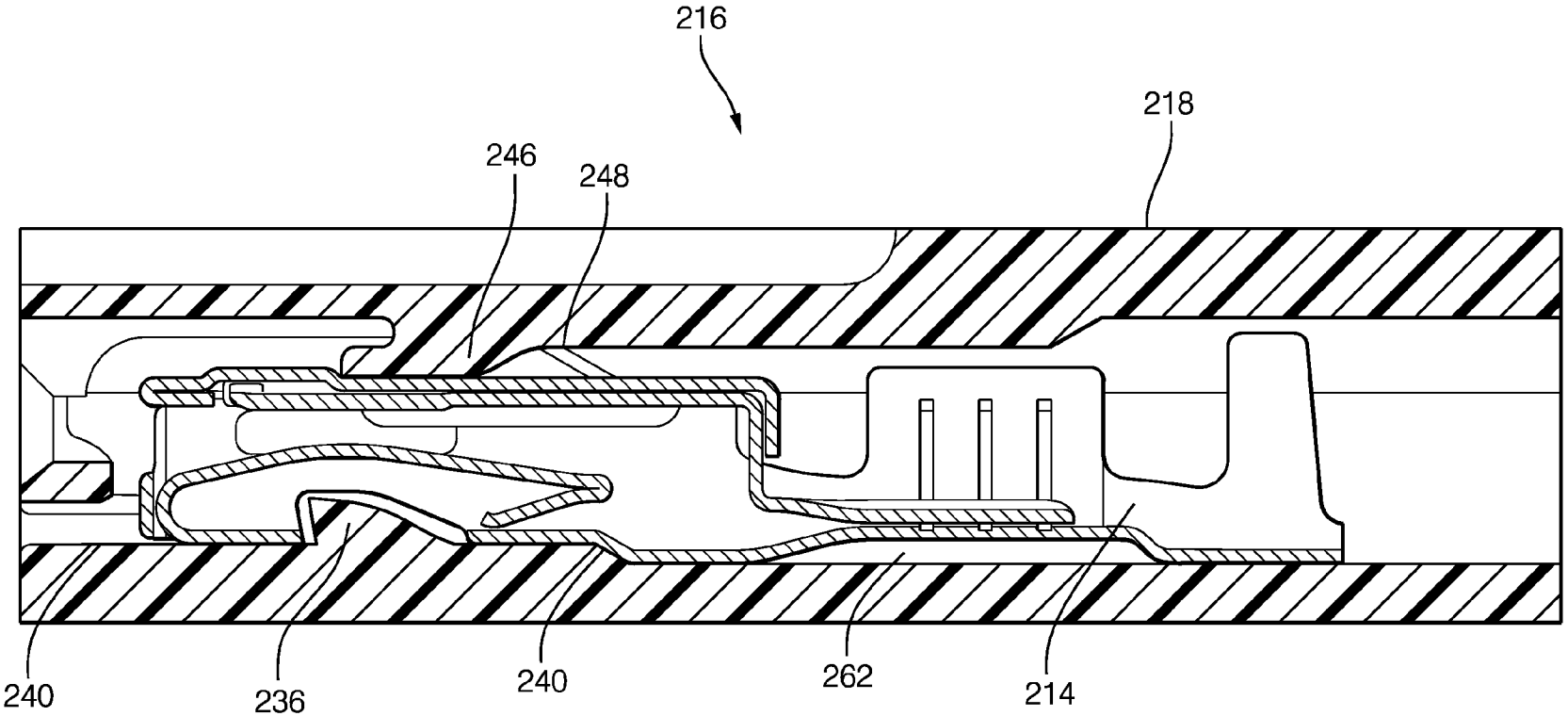
FIG. 8 is a cross section side view of the electrical connector of FIG. 6 according to the second embodiment.

The electrical connector 216 illustrated in FIG. 7 includes a connector body 218 that defines a terminal cavity 220 extending along a longitudinal axis X within the connector body 218. The terminal cavity 220 has two openings; the first opening 222 at an insertion end of the connector body 218 is configured to receive an electrical terminal 214 when it is inserted within the terminal cavity 220. The second opening 224, opposite the first opening 222, is configured to position the terminal 214 within the connector body 218 so that it can receive a mating terminal of a mating electrical connector (not shown). Although the connector body 218 illustrated in FIG. 6 has a single terminal cavity 220, other embodiments of the electrical connector 216 may be envisioned wherein the connector body 218 includes a plurality of terminal cavities 220.

The terminal 214 is at least partially disposed within the terminal cavity 220. The terminal 214 includes a connection section 226 configured to receive and connect with a mating terminal and an attachment section 228 configured to receive and attach to the stands of the wire 12. The attachment section 228 illustrated here comprises a pair of crimping wings 230 that are configured to be mechanically crimped to the stands of the wire 12. Other means for attaching the wire 12 to the terminal 214, such as soldering or sonic welding may be used and the design of the attachment section 228 may be revised accordingly. When inserted in the terminal cavity 220, the connection section 226 is proximate the second opening 224 of the terminal cavity 220 and the attachment section 228 is proximate the first opening 222 of the terminal cavity 220. The terminal 214 may be formed of a sheet of a conductive material, such as copper by a process of stamping and bending. While the embodiment illustrated in FIGS. 7-10 contains a socket electrical terminal configured to receive a male blade terminal (not shown), other embodiments of the electrical connector 216 may be envisioned using other terminal types, e.g. socket and pin.

The connection section 226 of the terminal 214 defines an opening 232 having locking edge 134 defined by a rearward edge that extends along a lateral axis Y and is configured to engage a lateral locking tab 236. The connection section 226 also defines a wedging surface 238 along the longitudinal axis X that is configured to engage a longitudinal wedge 240. The wedging surface 238 is defined by a longitudinal slot 242 in the connection section 226. In this example, the wedging surface 238 has an upper wall 264 and two tapered sidewalls 266 configured to contact the wedging surfaces 256 of the wedge 240.

The electrical connector 216 also includes a biasing feature 246 within the terminal cavity 220 that biases, i.e. pushes, the terminal 214 away from the first wall 248 of the terminal cavity 220 and toward a second wall 262 opposite the first wall 248. According to the embodiment of FIG. 6, the biasing feature 246 is a resilient beam 246 that depends from the first wall 248 of the terminal cavity 220. The beam 246 is a compliant fixed beam with both ends attached to the first wall 248 of the terminal cavity 220 and extending along the longitudinal axis X. The beam 246 may be integrally formed with the connector body 218 and may be formed of the same material as the connector body 218. Although the biasing feature 246 shown in this example is a compliant fixed beam, other embodiments may be envisioned with alternative biasing features, such as resilient cantilever beams, springs, or elastomeric elements.

The locking tab 236 is defined by a second wall 262 of the terminal cavity 220 opposite the first wall 248 defining the biasing feature 246. The locking tab 236 has a ramp 252 that slopes toward the first opening 222 of the terminal cavity 220. The ramp 252 leads to a lock shoulder 254 that extends along the lateral axis Y. The lock shoulder 254 is preferably, but not necessarily, set at a slight back angle.

The terminal 214 is inserted into the terminal cavity 220 through the first opening 222 at the insertion end of the connector body 218. As best shown in FIG. 7, when the connection section 226 of the terminal 214 engages the ramp 252 of the beam 246, the connection section 226 deflects the resilient beam 246 along a vertical axis Z so that the connection section 226 of terminal 214 rides up the ramp 252 and over the locking tab 236 as terminal 214 is further inserted within the terminal cavity 220. When the lock shoulder 254 reaches the locking edge 234 of the opening 232, the connection section 226 is biased toward the second wall 262 and the resilient beam 246 springs back to a generally undeflected position. The lock shoulder 254 engages the locking edge 234 of the terminal 214, inhibiting the terminal 214 from being pulled back out of the insertion end of the connector body 218 and inhibiting longitudinal movement of the terminal 214 within the terminal cavity 220.

The second wall 262 of the terminal cavity 220 also defines a wedge 240 extending longitudinally along the longitudinal axis X of the terminal cavity 220 both forward and rearward of the locking tab 236. The sides 256 of the wedge 240 taper away from side walls 268 of the terminal cavity 220 adjacent the second wall 262 and are configured to engage the two tapered sidewalls 266 of the slot 242. When the beam 246 springs back to the undeflected position the sides 256 of the wedge 240 are in intimate contact with the two tapered sidewalls 266 of the slot 242. Without subscribing to any particular theory of operation, the engagement of the wedge 240 with the tapered sidewalls 266 inhibits lateral movement of the terminal 214 within the terminal cavity 220. In combination with the locking tab 236 which limits longitudinal motion of the terminal 214 and the beam 246 which limits vertical motion of the terminal 214, the movement of the terminal 214 within the terminal cavity 220 is inhibited in three orthogonal axes.

Although not shown in FIGS. 7-10, the electrical connector 216 may further includes a lock retainer that is disposed within a gap directly above beam 246. The retainer is sandwiched between the beam 246 and an upper wall (not shown). The upper wall has a ramp positioned at the longitudinal center of the beam 246 to force the retainer down into interference with the beam and thus into the terminal/wedge. In addition to inhibiting vertical movement of the beam 246 that could cause inadvertent release of the terminal 214 from the terminal cavity 220, the lock retainer is configured to further urge the wedge 240 into intimate contact with the wedging surface 238 of the terminal 214.

Figure 9:
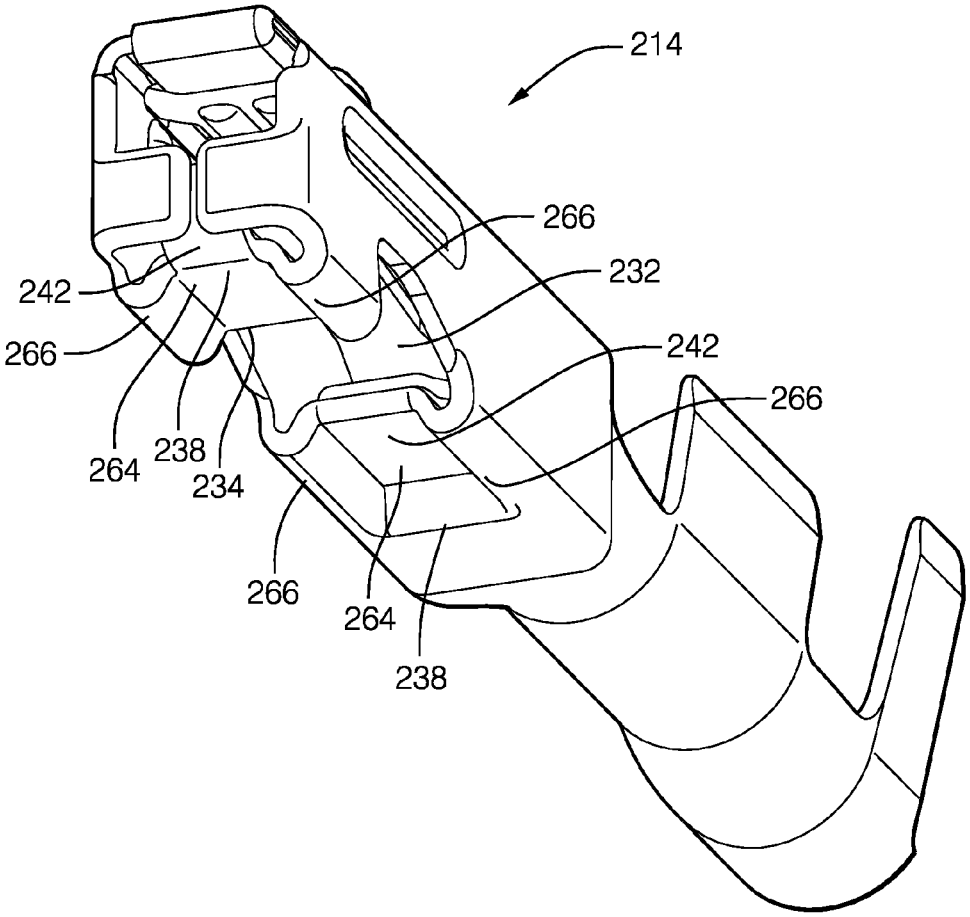
FIG. 9 is a perspective view of the electrical terminal of FIG. 6 according to the second embodiment.
Figure 10:
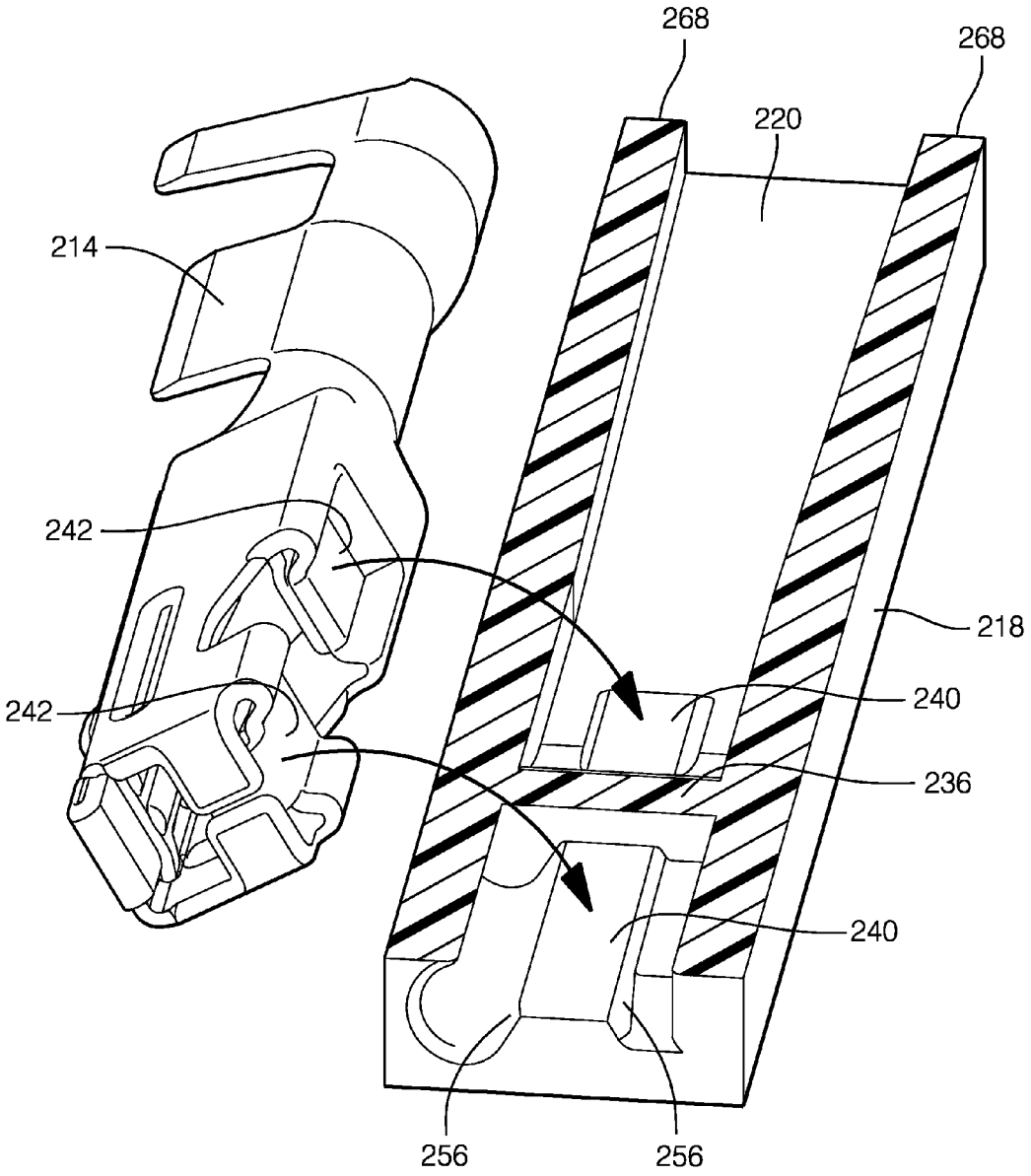
FIG. 10 is an exploded view of the electrical connector of FIG. 6 according to the second embodiment with a partial cutaway view of the connector body.

As best illustrated in FIGS. 9 and 10, the slot 242 runs length of connection section 226. In addition to providing the wedging surface 238 for the wedge 240, the slot 242 may cooperate with the wedge 240 to index terminals within the terminal cavity 220. The index may be used to center the terminal 214 within the terminal cavity 220 and/or ensure that the terminal 214 is properly oriented e.g. the terminal 214 is not inserted into the terminal cavity 220 upside down.

Accordingly an electrical wire assembly 10 and an electrical connector 116, 216 are provided. The connector body 118, 218 of the electrical connector 116, 216 includes a wedge feature 140, 240 that engages a wedging surface 138, 238 in the terminal 114, 214 to inhibit motion of the terminal 114, 214 within the connector body 118, 218 that may be caused by a mechanical vibration in the environment of the electrical connector 116, 216. Limiting motion of the terminal 114, 214 within the terminal cavity 120, 220 provides the benefit of decreasing fretting corrosion between the terminal 114, 214 and a mating terminal of a mating electrical connector. The features of this invention may be applied to existing electrical connector designs by including a longitudinal slot in the connection section of the terminal and a wedge feature in the connector body. Neither of these modifications requires an increase in the contact force between mated terminals nor are they likely to cause increased contact force. Thereby, existing connector designs may be modified to provide decreased fretting corrosion without increasing the insertion force needed to mate the connectors.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector, comprising:

a connector body defining a terminal cavity;

an electrical terminal at least partially disposed within said terminal cavity, wherein the terminal defines a rectangular opening in an external surface of the terminal having a lateral locking edge and wherein the terminal defines a longitudinal slot in the external surface of the terminal;

a resilient locking arm depending from a wall of the terminal cavity in the form of a cantilever beam with one end attached to the wall of the terminal cavity and extending along the longitudinal axis to a free end; and a lateral locking tab depending from the free end of the locking arm having a lateral lock shoulder and a longitudinal wedge, wherein the longitudinal wedge is tapered away from the locking arm and wherein the locking arm is configured to urge the locking tab into intimate contact with the external surface of the terminal, the lateral locking edge, and the longitudinal slot, thereby limiting vertical, longitudinal, and lateral motion of the terminal within the terminal cavity.

2. The electrical connector according to claim 1, further comprising a lock retainer disposed between the locking arm and the first cavity wall, wherein the lock retainer is configured to inhibit vertical movement of the locking arm and wherein a leading edge of the lock retainer is tapered to further urge the locking tab into intimate contact with the surfaces of the terminal, the wedging surface, and the slot as it is inserted between the locking arm and the first cavity wall.

3. The electrical connector according to claim 1, wherein the terminal is characterized as a socket terminal.

4. An electrical wiring assembly, comprising:

an electrically conductive wire; and the electrical connector according to claim 1, wherein the wire is electrically and mechanically connected to the electrical terminal.

5. An electrical connector, comprising:

a connector body defining a terminal cavity;

an electrical terminal having a connection section disposed within said terminal cavity, wherein said connection section defines a lateral locking edge;

a lateral locking tab depending from a first wall of the terminal cavity and configured to engage said locking edge, thereby inhibiting longitudinal movement of the terminal within the terminal cavity;

a resilient beam depending from a second wall of the terminal cavity opposite the first wall and configured to urge said connection section toward the first wall, thereby inhibiting vertical movement of the terminal within the terminal cavity; and a longitudinal wedge depending from the first wall of the terminal cavity, wherein the connection section of the terminal defines a longitudinal slot configured to receive the wedge and wherein the resilient beam urges an inner edge of the slot into intimate contact with the longitudinal wedge, thereby inhibiting lateral movement of the terminal within the terminal cavity.

6. The electrical connector according to claim 5, wherein the longitudinal wedge is located both forward and rearward of the locking tab and wherein the longitudinal slot is located both forward and rearward of the locking edge.

7. The electrical connector according to claim 5, wherein the terminal is characterized as a socket terminal and the connection section defines a box shape.

8. An electrical wiring assembly, comprising:

an electrically conductive wire; and the electrical connector according to claim 5, wherein the wire is electrically and mechanically connected to the electrical terminal.

9. The electrical connector according to claim 5, wherein the longitudinal wedge is tapered away from the first wall.

* * * * *